United States Patent [19]

Genev

[11] Patent Number: 4,855,039

[45] Date of Patent: Aug. 8, 1989

[54] VIBRATING SCREEN

[75] Inventor: Ivan V. Genev, Sofia, Bulgaria

[73] Assignee: Institute Po Tcherna Metalurgia, Sofia, Bulgaria

[21] Appl. No.: 158,191

[22] Filed: Feb. 19, 1988

[51] Int. Cl.[4] ..... B07B 1/28

[52] U.S. Cl. ..... 209/311; 209/313; 209/315

[58] Field of Search ..... 209/311, 313–315, 209/316, 317, 370, 319

[56] References Cited

U.S. PATENT DOCUMENTS

| | | | |
|---|---|---|---|
| 808,724 | 1/1906 | Case | 209/332 X |
| 1,468,005 | 9/1923 | Coyle et al. | 209/315 X |
| 2,058,959 | 10/1936 | Denning | 209/315 |
| 3,254,765 | 6/1966 | Mogensen | 209/316 |
| 3,817,376 | 6/1974 | Burstlein | 209/314 X |

FOREIGN PATENT DOCUMENTS

| | | | |
|---|---|---|---|
| 1044061 | 11/1955 | France | 209/315 |
| 466055 | 8/1975 | U.S.S.R. . | |
| 1080883 | 3/1984 | U.S.S.R. | 209/314 |

*Primary Examiner*—Robert B. Reeves
*Assistant Examiner*—Donald T. Hajec
*Attorney, Agent, or Firm*—Klein & Vibber

[57] ABSTRACT

A vibrating screen which comprises a housing having screening surfaces, the surfaces forming an angle with respect to each other, and vibrators. The housing consists of separate sections having screening surfaces arranged, one underneath the other, inside of each section. Each section is suspended to a frame by means of flexible joints. Vibrators are mounted to each section. The screening surfaces of the separate sections are arranged at different inclinations and have different widths in the downward direction of motion of the material passing through the vibrating screen device.

4 Claims, 1 Drawing Sheet

VIBRATING SCREEN

BACKGROUND OF THE INVENTION

A. Field of the Invention

The invention relates to a vibrating screen which can be used for the granulometric separation and screening of bulk materials, particularly in the mining and ore preparation industry, as well as in the building industry.

B. Description of the Prior Art

A known device for the separation of bulk materials is to be found in USSR Inventor's Certificate No. 466055, Int. Cl. B 07 B1/40 and consists of a housing, in the inside of which there are arranged, one underneath the other, screening surfaces at different inclinations in the direction of motion of the material. The housing is suspended to a rigid frame by means of flexible joints, and a vibrator is mounted to the housing.

Drawbacks of the known device include low productivity and efficiency of screening, difficult maintenance because of the complexity of the design, as well as large overall size of the device.

SUMMARY OF THE INVENTION

It is the object of this invention to develop a vibrating screen having high efficiency and productivity, which is easy to operate and maintain.

This object is achieved by a vibrating screen which includes a housing having vibrators and screening surfaces which form angles with respect to each other. The housing is divided into separate individual sections having screening surfaces arranged one underneath the other inside the sections. Each section is suspended to a rigid frame by means of flexible joints. A vibrator is attached to each section. The screening surfaces of the different sections are arranged at different inclinations with respect to each other and vary in width in the downward direction of motion of the material passing through the device.

The advantages of this inventive vibrating screen lies in its increased efficiency of screening, which is due to the different widths and the inclination of the screening surfaces of the different sections, and because the technical parameters of each section can be regulated separately and optimally by means of the vibrators, thereby allowing the screen to operate more efficiently.

For a better understanding of the invention, reference should be made to the accompanying drawings which illustrate and describe a preferred embodiment of the invention.

DETAILED DESCRIPTION

Figure 1:
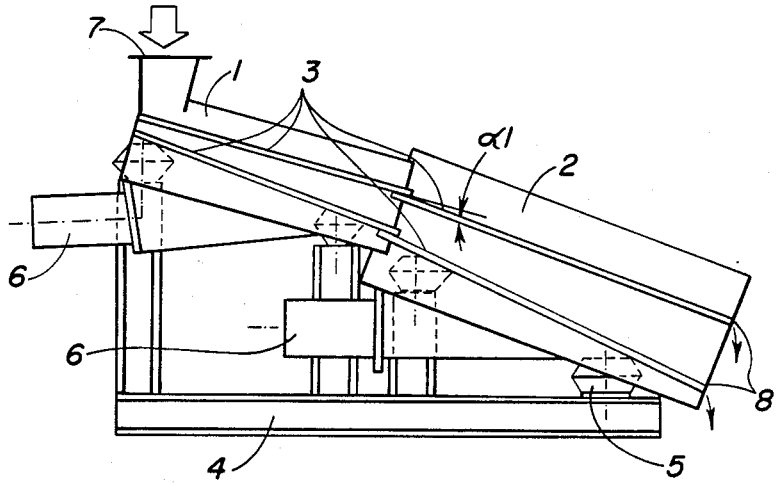
FIG. 1 shows a longitudinal cross-sectional view through a vibrating screen.
Figure 2:
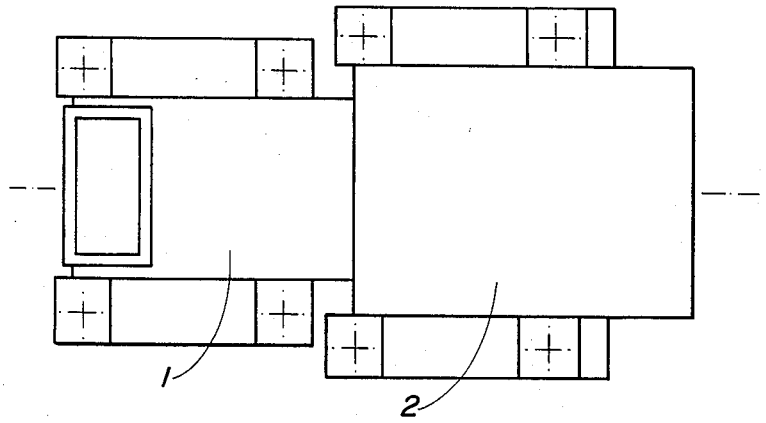
FIG. 2 shows a top view of the same.

The vibrating screen according to the invention comprises a housing having screening surfaces and vibrators. The planes of the screening surfaces are at an angle with respect to each other. The housing is divided into separate indivdual sections, a first section 1 and a second section 2. Screening surfaces 3 are arranged, one underneath the other, in the inside of each section. Each section 1 and 2 is suspended to a frame 4 by means of flexible elements 5. Vibrators 7 are mounted to each section. The screening surfaces 3 of the different sections 1 and 2 are arranged at different inclinations with respect to each other and have different widths with respect to each other in the downward direction of motion of the material passing through the device. The device is provided with an inlet passage 7 and outlet passages 8.

The operation of the vibrating screen according to the invention is as follows:

The bulk material is loaded through the inlet passage 7 onto the top screening surface 3 of section 1. As a result of high-frequency vibrations the material moves downward along the screening surfaces 3 and is separated by size into layers, the small pieces "sinking down", while the large pieces emerge on the surface of the material layer. The thus separated material enters the second section 2 and subsequently the next-following sections. The second section 2 and the subsequently next-following sections are characterized by having greater width, greater inclination of the screening surfaces, and greater vibration frequency than the immediately preceding section. Thus, the process of screening is accelerated without the necessity of additionally increasing the total length of the screen. The screened material, moving from section to section, passes in turn over the screening surfaces and over the bottoms of the sections towards the outlet passages 8 of the last section 2. Each section is mounted individually by means of separate flexible joints 5 to the common frame 4. Since every section is driven by an individual vibrator 6, it is possible to optimize the working conditions individually for each section, thereby achieving maximum operational efficiency of the whole screen assembly.

Although the invention is described and illustrated with reference to a specific embodiment thereof, it is to be expressly understood that it is in no way limited to the disclosure of such a preferred embodiment, but is capable of numerous modifications within the scope of the appended claims.

I claim:

1. A vibrating screen for the granulometric separation of bulk materials comprising a first section having a first upper screening surface and a first lower screening surface, said first screening surfaces being arranged at an angle with respect to each other;

a second section having a second upper screening surface and a second lower screening surface, said second screening surfaces being arranged at an angle with respect to each other;

said second screening surfaces being wider than said first screening surfaces;

said second section being arranged downstream of said first section whereby said bulk materials flow from said first section to said second section;

said second upper screening surface being arranged below said first upper screening surface and said second lower screening surface being arranged below said first lower screening surface, whereby said bulk materials flow from said first upper screening surface to said second upper screening surface and materials passing through said first upper screening surface onto said first lower screening surface flow from said first lower screening surface to said second lower screening surface;

said first section and said second section being independently mounted for vibration independent of each other.

2. A vibrating screen as claimed in claim 1 wherein the angle between said second screening surfaces is different than the angle between said first screening surfaces.

3. A vibrating screen as claimed in claim 1 wherein the first section and the second section are mounted to a frame by flexible joints.

4. A vibrating screen as claimed in claim 1 wherein the first section and the section are provided with respective separate vibration means, whereby said first section and said second section can be vibrated at different frequencies and amplitudes.

* * * * *